US008577264B2

(12) United States Patent
Akedo

(10) Patent No.: US 8,577,264 B2
(45) Date of Patent: Nov. 5, 2013

(54) DEVELOPING DEVICE AND IMAGE FORMING APPARATUS PROVIDED WITH SAME

(75) Inventor: Shuichi Akedo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 302 days.

(21) Appl. No.: 13/090,509

(22) Filed: Apr. 20, 2011

(65) Prior Publication Data

US 2011/0262187 A1 Oct. 27, 2011

(30) Foreign Application Priority Data

Apr. 23, 2010 (JP) ..... 2010-099621

(51) Int. Cl.
*G03G 15/08* (2006.01)

(52) U.S. Cl.
USPC ..... 399/254

(58) Field of Classification Search
USPC ..... 399/254
See application file for complete search history.

(56) References Cited

U.S. PATENT DOCUMENTS

| | | | | |
|---|---|---|---|---|
| 5,450,178 | A * | 9/1995 | Kawashima et al. | 399/262 |
| 6,347,207 | B1 | 2/2002 | Ishiguro et al. | |
| 7,493,068 | B2 * | 2/2009 | Tatsumi et al. | 399/254 |
| 7,519,315 | B2 * | 4/2009 | Tatsumi et al. | 399/254 |
| 7,925,186 | B2 * | 4/2011 | Miyata et al. | 399/253 |
| 7,957,678 | B2 * | 6/2011 | Hosokawa et al. | 399/254 |
| 8,045,892 | B2 * | 10/2011 | Sakata et al. | 399/254 |
| 8,045,895 | B2 * | 10/2011 | Matsumoto et al. | 399/254 |
| 2006/0115302 | A1 * | 6/2006 | Hosokawa et al. | 399/254 |
| 2006/0245792 | A1 | 11/2006 | Tatsumi et al. | |
| 2007/0274741 | A1 | 11/2007 | Shiraishi et al. | |
| 2008/0056770 | A1 * | 3/2008 | Miyata et al. | 399/253 |
| 2008/0226349 | A1 | 9/2008 | Iwata et al. | |
| 2008/0267668 | A1 * | 10/2008 | Sakata et al. | 399/254 |
| 2009/0180812 | A1 | 7/2009 | Kunihiro | |
| 2010/0061769 | A1 | 3/2010 | Tanisawa | |
| 2010/0098463 | A1 * | 4/2010 | Matsumoto et al. | 399/254 |
| 2010/0124443 | A1 * | 5/2010 | Ohmura et al. | 399/254 |

FOREIGN PATENT DOCUMENTS

| | | | |
|---|---|---|---|
| CN | 1257227 | A | 6/2000 |
| CN | 101673074 | A | 3/2010 |
| JP | 2005-024592 | A | 1/2005 |
| JP | 2006-099022 | A | 4/2006 |

(Continued)

*Primary Examiner* — David Gray
*Assistant Examiner* — G. M. Hyder
(74) *Attorney, Agent, or Firm* — Renner, Otto, Boisselle & Sklar, LLP

(57) ABSTRACT

A developing device includes: a developing tank for storing a developer containing a toner and a magnetic carrier, the developing tank including, inside thereof, a first developer carrying path; and a first stirring carrying member that rotates so that the first stirring carrying member carries the developer included in the first developer carrying path while stirring the developer. A toner supply opening is formed in a developing tank cover. An upper part of an inner wall surface of a side in which a developer sinks which inner wall surface faces downward rotation of the first stirring carrying member inclines from a direction perpendicular to a horizontal surface toward the first developer carrying path. An angle α made by (i) a tangential line of the upper inner wall surface at a position of the upper inner wall surface which position is at a height of a top part of an outer circumference of the first stirring carrying member and (ii) a horizontal line is not less than 100° but not more than 150°. This makes it possible to properly stir a supplied toner with an existing developer without applying excessive stress on the developer.

4 Claims, 6 Drawing Sheets

(56) References Cited

FOREIGN PATENT DOCUMENTS

| | | | |
|---|---|---|---|
| JP | 2007-094160 | | 4/2007 |
| JP | 2007-147806 | | 6/2007 |
| JP | 2007-316130 | A | 12/2007 |
| JP | 2008-233243 | A | 10/2008 |
| JP | 2009-168954 | A | 7/2009 |

* cited by examiner

DEVELOPING DEVICE AND IMAGE FORMING APPARATUS PROVIDED WITH SAME

This Nonprovisional application claims priority under 35 U.S.C. §119(a) on Patent Application No. 2010-099621 filed in Japan on Apr. 23, 2010, the entire contents of which are hereby incorporated by reference.

TECHNICAL FIELD

The present invention relates to a developing device and an image forming apparatus. The present invention particularly relates to: a developing device employing a two-component developer containing a toner and a magnetic carrier; and an image forming apparatus such as an electrostatic copying machine, a laser printer or a facsimile, which is provided with the developing device and forms an image by means of electrophotographic printing method.

BACKGROUND ART

Conventionally, electrophotographic image forming apparatuses such as a copying machine, a printer and facsimile have been known. In these electrophotographic image forming apparatuses, an electrostatic image latent image in accordance with an image is formed on a surface of a photoreceptor drum (toner image bearing member), the electrostatic latent image is developed by a developing device to be a toner image, the toner image is transferred from the photoreceptor drum to a sheet such as paper, and the toner image transferred to the sheet is fixed to the sheet by a fixing device.

In order to comply with full color and high definition, a recent image forming apparatus employs a two component developer (hereinafter simply referred to as a developer) excellent in charging stability of a toner. The developer consists of a toner and a carrier, and is stirred in a developing device. The stirring causes friction between the toner and the carrier. The friction causes the toner to be properly charged.

The toner charged in the developing device, which toner is used for developing the electrostatic latent image, is supplied to a developer bearing member, for example, a surface of a developing roller. The toner supplied to the developer bearing member is carried by electrostatic attraction to the electrostatic latent image formed on the photoreceptor drum. In this manner, the toner image in accordance with the electrostatic latent image is formed on the photoreceptor drum.

Downsizing and speeding up are required for the image forming apparatus. In order to attain speeding up, it is necessary to immediately and sufficiently charge the developer and immediately carry the developer.

For example, Patent Literature 1 discloses a circulatory developing device for solving the above problem. The circulatory developing device is provided with two developer carrying paths through which the developer is circularly carried and two auger screws that carry the developer through the developer carrying paths while stirring the developer, so that a supplied toner is immediately dispersed in the developer and an appropriate quantity of charging is applied to the toner.

Further, Patent Literature 2 discloses another circulatory developing device for solving the above problem. The another circulatory developing device is provided with two developing carrying paths through which the developer is circularly carried and two auger screws that carry the developer through the developer carrying paths while stirring the developer. Further, a magnet that forms a magnetic brush is provided in the developer carrying path below a toner supply opening.

The magnet prevents an insufficiently charged toner (low charged toner) from being supplied to the developer bearing member.

CITATION LIST

Patent Literature

Patent Literature 1

Japanese Patent Application Publication Tokukai No. 2005-24592 A (Publication Date: Jan. 27, 2005)

Patent Literature 2

Japanese Patent Application Publication Tokukai No. 2009-168954 A (Publication Date: Jul. 30, 2009)

SUMMARY OF INVENTION

Technical Problem

However, according to the above-described conventional circulatory developing devices, there is a possibility that a toner supplied from a toner hopper to developer carrying paths is not sufficiently mixed with a developer already present in the developer carrying paths to be a clumpy toner, and the clumpy toner is circularly carried through the developer carrying paths. That is, the toner separated from a carrier is possibly circularly carried through the developer carrying paths. As a result of this, the toner that has not been sufficiently charged due to friction against the carrier is supplied to a developer bearing member, thereby causing a problem that the toner adheres to a part where an image is not to be formed, that is, photographic fog, or the toner scatters.

Specifically, the developing device disclosed in Patent Literature 1 supplies the toner from the toner hopper to the developer carrying paths in a case where density of the toner included in the developer present in the developing device reaches below a predetermined value. Specific gravity of the toner is substantially one-third of that of the developer (carrier). This specific gravity of the toner is quite small. Therefore, the toner supplied to the developing device is easy to float in an upper part of the developer. Therefore, according to the circulatory developing device disclosed in Patent Literature 1, the clumpy toner is easily carried in the upper part of the developer in a case where a great amount of toner is supplied to the developer carrying paths. As a result of this, a toner insufficiently mixed with the developer, that is, a low charged toner in insufficient contact with the carrier is supplied to the developer bearing member.

Meanwhile, Patent Literature 2 discloses the developing device in which a magnet that forms a magnetic brush is provided in developer carrying paths below a toner supply opening. The magnetic brush of the developing device promotes stirring a supplied toner with a developer. However, the magnetic brush applies excessive stress, that is, excessive shearing force on the developer. This causes the developer to generate heat. The heat softens a resin component of the toner. This impairs fluidity of the developer (toner) thereby deteriorating in an image quality.

The present invention was made in view of the conventional problem, and an object of the present invention is to provide a developing device capable of properly stirring a supplied toner with an existing developer without applying excessive stress on the developer, and an image forming apparatus provided with the developing device.

Solution to Problem

In order to attain the object, a developing device of the present invention including: a developing tank for storing a developer containing a toner and a magnetic carrier, the developing tank including, inside thereof, a developer carrying path that extends in one direction; and a stirring carrying member which is provided in the developer carrying path and which rotates so that the stirring carrying member carries the developer included in the developer carrying path while stirring the developer, the developing device developing by use of the developer carried from the developer carrying path by the stirring carrying member, the developing tank having an upper wall above the developer carrying path, the upper wall having a toner supply opening through which a toner is supplied to the developer carrying path from an outside, the developer carrying path being defined by first and second sidewalls present respectively in both sides of the width direction of the developer carrying path, the first sidewall facing downward rotation of the stirring carrying member, the first sidewall having an inner wall surface that has an upper part inclining from a direction perpendicular to a horizontal surface toward the developer carrying path, and an angle $\alpha$ made by (i) a tangential line of the inner wall surface of the first sidewall at a position of the inner wall surface of the first sidewall which position is at a height of a top part of an outer circumference of the stirring carrying member and (ii) a horizontal line being not less than 100° but not more than 150°.

According to the above arrangement, the toner to be supplied to the developer carrying path is supplied from the toner supply opening into the developer carrying path. By rotation of the stirring carrying member, the toner supplied to the developer carrying path is carried in one direction while being stirred with an existing developer. Thereafter, the toner included in the carried developer is, for example, held on a surface of the developing roller, and used for developing an electrostatic latent image formed on a surface of a photoreceptor.

The toner supplied from the toner supply opening into the developer carrying path has an apparent density smaller (lighter) than that of the developer (magnetic carrier). Therefore, the toner is easy to float in an upper part of the developer. As described above, the upper part of the inner wall surface of the first sidewall inclines from the direction perpendicular to the horizontal surface toward the developer carrying path. Further, the angle $\alpha$ made by (i) the tangential line of the inner wall surface of the first sidewall at the position of the inner wall surface of the first sidewall which position is at the height of the top part of the outer circumference of the stirring carrying member and (ii) the horizontal line is not less than 100° but not more than 150°.

This arrangement makes it possible to properly stir the supplied toner with the existing developer without applying excessive stress on the developer, by rotation of the stirring carrying member. That is, even in a case where the toner floats in the upper part of the developer, the toner supplied into the developer carrying path is easily captured, by rotation of the stirring carrying member, between the inner wall surface of the first sidewall and the stirring carrying member. The toner captured between the inner wall surface of the first sidewall and the stirring carrying member is subject to shearing force from the stirring carrying member. This makes it easy to stir the toner with the developer so as to disperse the toner in the developer.

Advantageous Effects of Invention

According to an arrangement of the present invention, it is possible to properly stir a supplied toner with an existing developer without applying excessive stress on the developer, by rotation of a stirring carrying member. That is, even in a case where the toner floats in an upper part of the developer, the toner supplied to a developer carrying path is easily captured between an inner wall surface of a first sidewall and the stirring carrying member by rotation of the stirring carrying member. The toner captured between the inner wall surface of the first sidewall and the stirring carrying member is subject to shearing force from the stirring carrying member. This makes it easy to stir the toner with the developer so as to disperse the toner in the developer.

As described above, the supplied toner is properly dispersed and stirred in the developer. This makes it possible to sufficiently charge the supplied toner thereby obtaining an image having no photographic fog or toner scattering.

DESCRIPTION OF EMBODIMENTS

The following describes an embodiment of the present invention with reference to Figures.

(Arrangement of Image Forming Apparatus)

Figure 1:
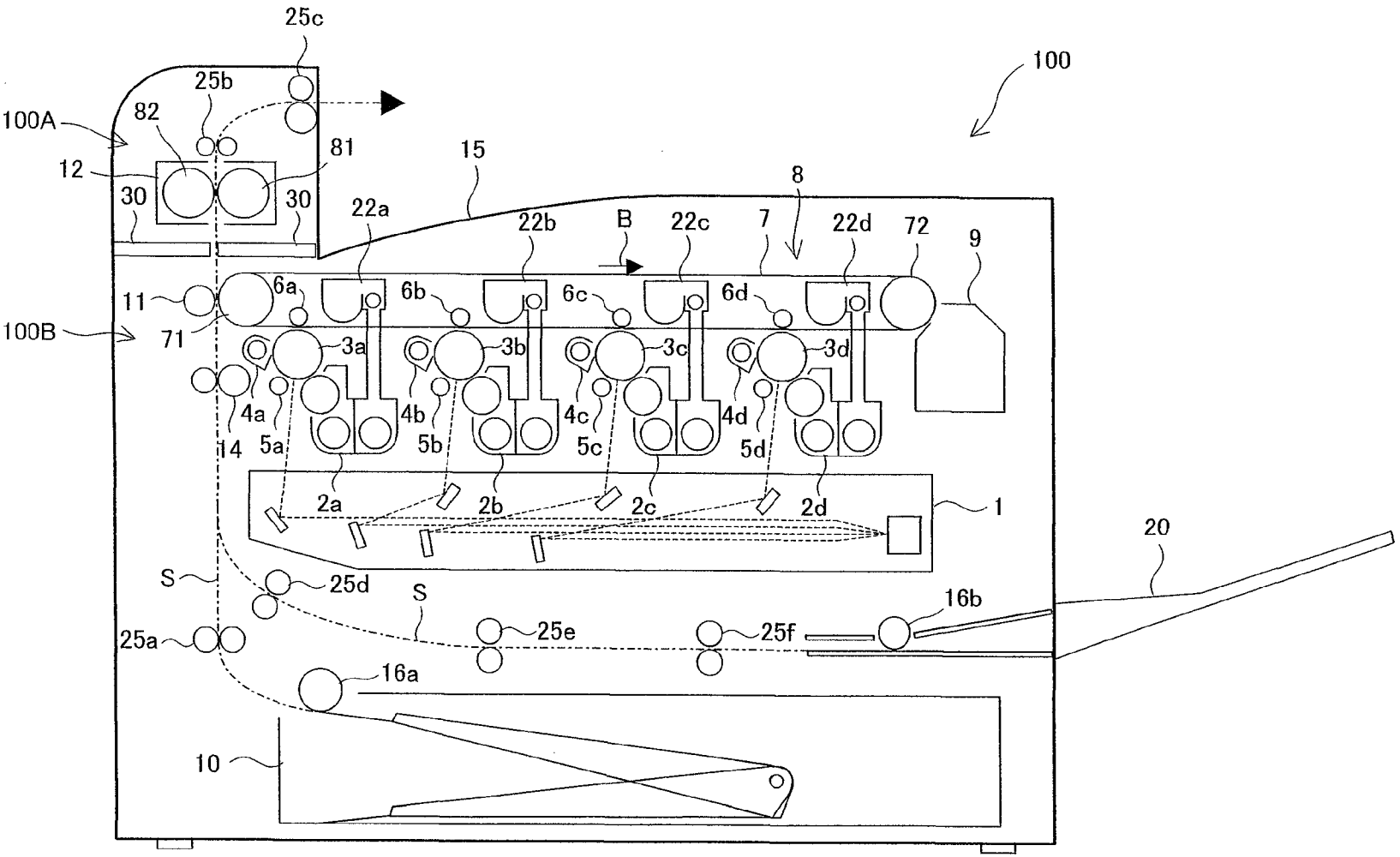
FIG. 1 is a view showing an arrangement of an image forming apparatus in accordance with an embodiment of the present invention.

FIG. 1 is a view showing an arrangement of an image forming apparatus in accordance with an embodiment of the present invention. The present embodiment describes, as an example, the image forming apparatus of the present invention, which is applied to a printer.

An image forming apparatus 100 shown in FIG. 1 forms, on a predetermined sheet (recording paper), a multicolored or monochrome image in accordance with image data inputted from an outside. An image reading device such as a scanner may be provided above the image forming apparatus 100.

The image forming apparatus 100 is provided with a fixing process section 100A and an image forming process section 100B. A blocking wall 30 is provided between the fixing process section 100A and the image forming process section 100B. The blocking wall 30 prevents heat of the fixing process section 100A from being transferred to the image forming process section 100B.

The fixing process section 100A is provided with a fixing device 12, a carrying roller 25*b* and a discharge roller 25*c*. The carrying roller 25*b* and the discharge roller 25*c* discharge, to a paper output tray 15, a sheet to which a toner image has been fixed by the fixing device 12.

The fixing device 12 includes a heat roller 81 and a pressure roller 82. These heat roller 81 and pressure roller rotate while sandwiching a sheet, and carry the sandwiched sheet. The heat roller 81 is controlled by a control section (not shown) so as to have a predetermined fixing temperature. The control section controls the heat roller 81 according to a detection signal outputted from a temperature detector (not shown).

The heat roller 81 and the pressure roller 82 press by heat, to a sheet, a toner image transferred to the sheet. That is, the heat roller 81 and the pressure roller 82 melt the toner image transferred to the sheet, and fix the toner image to the sheet. The sheet on which the toner image (colored toner image) is fixed is discharged to the paper output tray 15 by the carrying roller 25*b* and the discharge roller 25*c*, the sheet being inverted, that is, the toner image fixed to the sheet facing downward.

The image forming process section 100B includes photoreceptor drums 3 (3*a*, 3*b*, 3*c* and 3*d*), charging devices 5 (5*a*, 5*b*, 5*c* and 5*d*), an exposure unit 1, developing devices 2 (2*a*, 2*b*, 2*c* and 2*d*), toner supply devices 22 (22*a*, 22*b*, 22*c* and 22*d*), cleaner units 4 (4*a*, 4*b*, 4*c* and 4*d*), and an intermediate transfer belt unit (transfer device) 8.

As to the above-described reference signs a to d, a indicates a member for forming a black image, b indicates a member for forming a cyan image, c indicates a member for forming a magenta image, and d indicates a member for forming a yellow image. The following photoreceptor drums 3 (3*a*, 3*b*, 3*c* and 3*d*), charging devices 5 (5*a*, 5*b*, 5*c* and 5*d*), developing devices 2 (2*a*, 2*b*, 2*c* and 2*d*), toner supply devices 22 (22*a*, 22*b*, 22*c* and 22*d*), and cleaner units 4 (4*a*, 4*b*, 4*c* and 4*d*) are, as appropriate, described just as the photoreceptor drum 3, the charging device 5, the developing device 2, the toner supply device 22, and the cleaner unit 4, respectively.

An electrostatic latent image in accordance with an image to be formed (printed) is formed on a surface of the photoreceptor drum 3. The photoreceptor drum 3 is a cylindrical member for forming a latent image due to charging and exposure to light, and shows electrical conductivity by irradiation with light. The photoreceptor drum 3 is axially rotatable, and rotated by driving means (not shown). Further, the photoreceptor drum 3 includes an electrically conductive substrate (not shown) and a photoreceptive layer (not shown) formed on a surface of the electrically conductive substrate.

The charging device 5 charges the surface of the photoreceptor drum 3 such that the surface of the photoreceptor drum 3 evenly has a predetermined electric potential. Examples of the charging device 5 encompass a contact brush-type charging device and a noncontact charge-type charging device, in addition to a contact roller-type charging device shown in FIG. 1.

By the exposure unit 1, the surface of the photoreceptor drum 3 charged by the charging device 5 is exposed to light so that an electrostatic latent image is formed on the surface of the photoreceptor drum 3. In order to form the electrostatic latent image, the exposure unit 1 irradiates the surface of the photoreceptor drum 3 with light in accordance with image data. In the present embodiment, the exposure unit 1 is a laser scanning unit (LSU) provided with a laser irradiation section and a reflection mirror. However, the exposure unit 1 may be an EL (electroluminescence) or a LED writing head in which light-emitting elements are arranged in an array shape, instead of the laser scanning unit.

The developing device 2 develops the electrostatic latent image formed on the surface of the photoreceptor drum 3 by use of any one of toners K, C, M and Y. In this manner, the toner image is formed.

The toner supply device 22 supplies a toner to the developing device 2. Specifically, the toner supply device 22 is provided above the developing device 2, and supplies the toner to the developing device 2 via a toner carrying pipe.

The cleaner unit 4 removes and collects a toner that remains on the surface of the photoreceptor drum 3 after a developing process and an image transfer process are conducted.

The image forming apparatus 100 of the above-described arrangement forms, on the surfaces of the photoreceptor drums 3 (3*a*, 3*b*, 3*c* and 3*d*), a black toner image, a cyan toner image, a magenta toner image and a yellow toner image in accordance with inputted image data of respective color components black (K), cyan (C), magenta (M) and yellow (Y), respectively. The formed toner images are transferred to and accumulated on the intermediate transfer belt 7 of the intermediate transfer belt unit 8 such that the formed toner images overlap with one another. In this manner, a colored image is formed on the intermediate transfer belt 7.

The intermediate transfer belt unit 8 is provided above the photoreceptor drum 3, and transfers, to a sheet, a toner image formed on the surface of the photoreceptor drum 3. The intermediate transfer belt unit 8 is provided with intermediate transfer rollers 6 (6*a*, 6*b*, 6*c* and 6*d*), an intermediate transfer belt 7, an intermediate transfer belt driving roller 71, an intermediate transfer belt driven roller 72, an intermediate transfer belt tension mechanism (not shown), and an intermediate transfer belt cleaning unit 9.

The intermediate transfer roller 6, the intermediate transfer belt driving roller 71, the intermediate transfer belt driven roller 72, and the intermediate transfer belt tension mechanism provide the intermediate transfer belt 7 in a tension state, and rotate the intermediate transfer belt 7 in a direction of arrow B shown in FIG. 1.

The intermediate transfer roller 6 is rotatably supported by the intermediate transfer belt tension mechanism. A bias voltage is applied to the intermediate transfer roller 6 so that the toner image formed on the surface of the photoreceptor drum 3 is transferred to the intermediate transfer belt 7. The toner image of the respective color components which toner image is formed on the surface of the photoreceptor drum 3 is sequentially transferred to the intermediate transfer belt 7 such that the toner images overlap with one another. This forms a colored toner image (multicolored toner image). The toner image is transferred from the photoreceptor drum 3 to the intermediate transfer belt 7 by the intermediate transfer roller 6 that contacts a reverse side of the intermediate transfer belt 7.

The toner image accumulated on the intermediate transfer belt 7 is carried, by rotation of the intermediate transfer belt 7, to a position (transfer section) where a carried sheet contacts the intermediate transfer belt 7, and transferred to the sheet by the transfer roller 11 provided in this position. Specifically, the intermediate transfer belt 7 and the transfer roller 11 are pressured against each other by a specific nip, and a voltage is applied to the transfer roller 11 so that the toner image is transferred to a sheet. In this manner, the toner image is transferred to the sheet.

A toner that adheres to the intermediate transfer belt 7 as a result of contacting the intermediate transfer belt 7 with the photoreceptor drum 3 and a toner that remains on the intermediate transfer belt 7 which toner has not been transferred from the intermediate transfer belt 7 to the sheet cause mixing of toners of different colors in a successive step. Therefore, these toners are removed and collected by the intermediate transfer belt cleaning unit 9.

Further, the image forming apparatus 100 is provided with a paper feeding tray 10, a sheet carrying path S and a paper output tray 15. The paper feeding tray 10 stores a sheet (for example, recording paper) to be used for forming an image, and is provided below an image forming section and the exposure unit 1. The paper output tray 15 provided in an upper part of the image forming apparatus 100 is a tray on which a printed sheet is to be placed such that a surface of the printed sheet on which surface an image is formed faces downward.

(Sheet Carrying Path)

As described above, the image forming apparatus 100 is provided with the sheet carrying path S that guides, via the transfer section and the fixing device 12 to the paper output tray 15, a sheet stored in the paper feeding tray 10 and a sheet stored in a manual paper feeding tray 20. The transfer section is positioned between the intermediate transfer belt driving roller 71 and the transfer roller 11.

Further, pick-up rollers 16 (16*a* and 16*b*), a resist roller 14, the transfer section, the fixing device 12, carrying rollers 25 (25*a* to 25*h*) and the like are provided along the sheet carrying path S.

The carrying roller 25 is a small roller for promoting and assisting carrying a sheet. A plurality of carrying rollers 25 are provided along the sheet carrying path S. The pick-up roller 16*a* is provided in an edge part of the paper feeding tray 10, and is a suction roller that supplies sheets one by one from the paper feeding tray 10 to the sheet carrying path S. The pick-up roller 16*b* is provided in the vicinity of the manual paper feeding tray 20, and is a suction roller that supplies sheets one by one from the manual paper feeding tray 20 to the sheet carrying path S. The resist roller 14 temporarily holds a sheet carried in the sheet carrying path S, and carries the sheet to the transfer section at a timing when an edge of the toner image accumulated on the intermediate transfer belt 7 lines up with an edge of the sheet.

A sheet carried from the paper feeding tray 10 is carried to the resist roller 14 by the carrying roller 25*a* provided along the sheet carrying path S, and carried by the resist roller 14 to the transfer section (position where the transfer roller 11 contacts the intermediate transfer belt 7) at the timing when the edge of the sheet lines up with the edge of the toner image accumulated on the intermediate transfer belt 7. In the transfer section, the toner image is transferred to the sheet. The toner image is then fixed to the sheet by the fixing device 12. Thereafter, the sheet is discharged onto the paper output tray 15 via the carrying roller 25*b* and the discharge roller 25*c*. Further, a sheet carried from the manual paper feeding tray 20 is carried to the resist roller 14 by the plurality of rollers 25 (25*f*, 25*e* and 25*d*). Thereafter, the sheet is discharged onto the paper output tray 15 in the same manner as the sheet carried from the paper feeding tray 10.

(Toner Supply Device)

Figure 2:
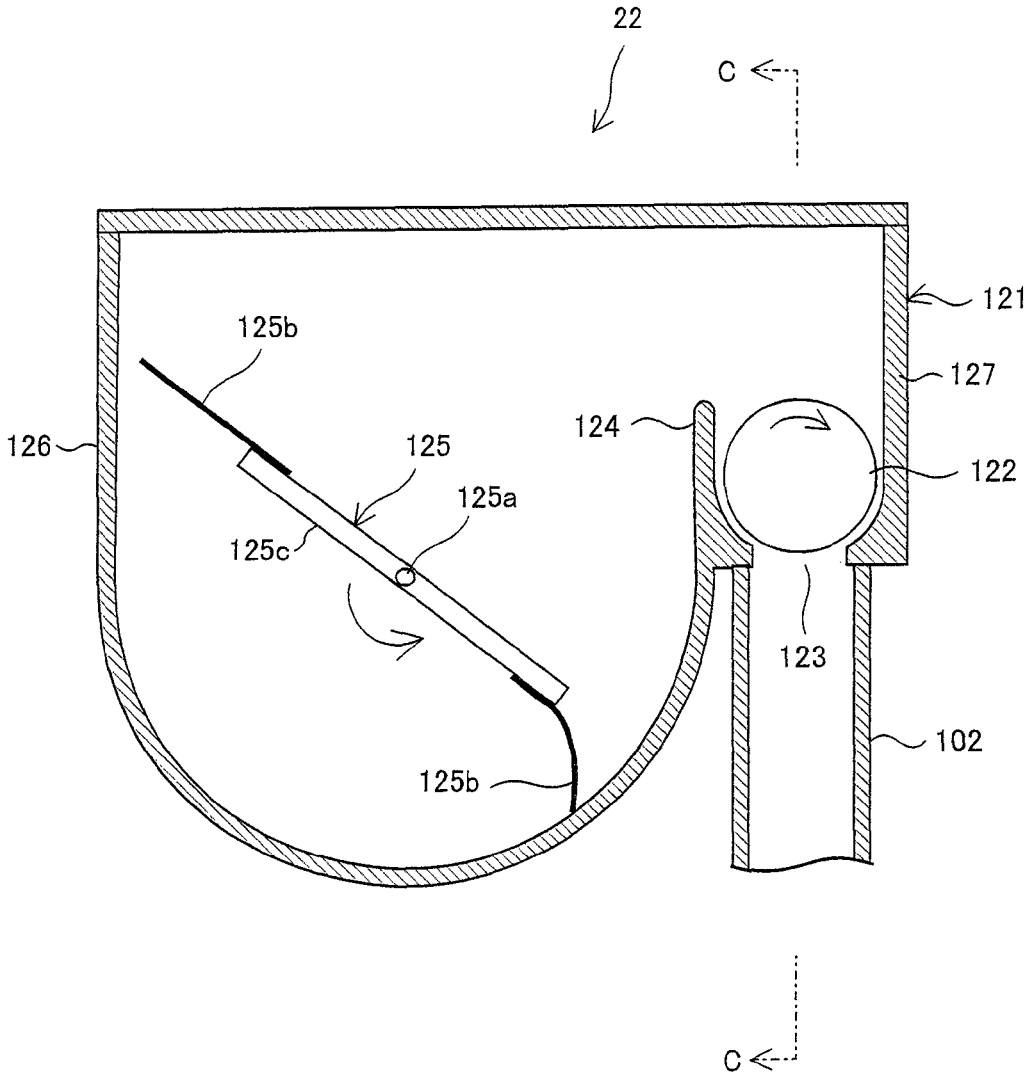
FIG. 2 is a longitudinal cross-sectional view showing an arrangement of a toner supply device shown in FIG. 1.
Figure 3:
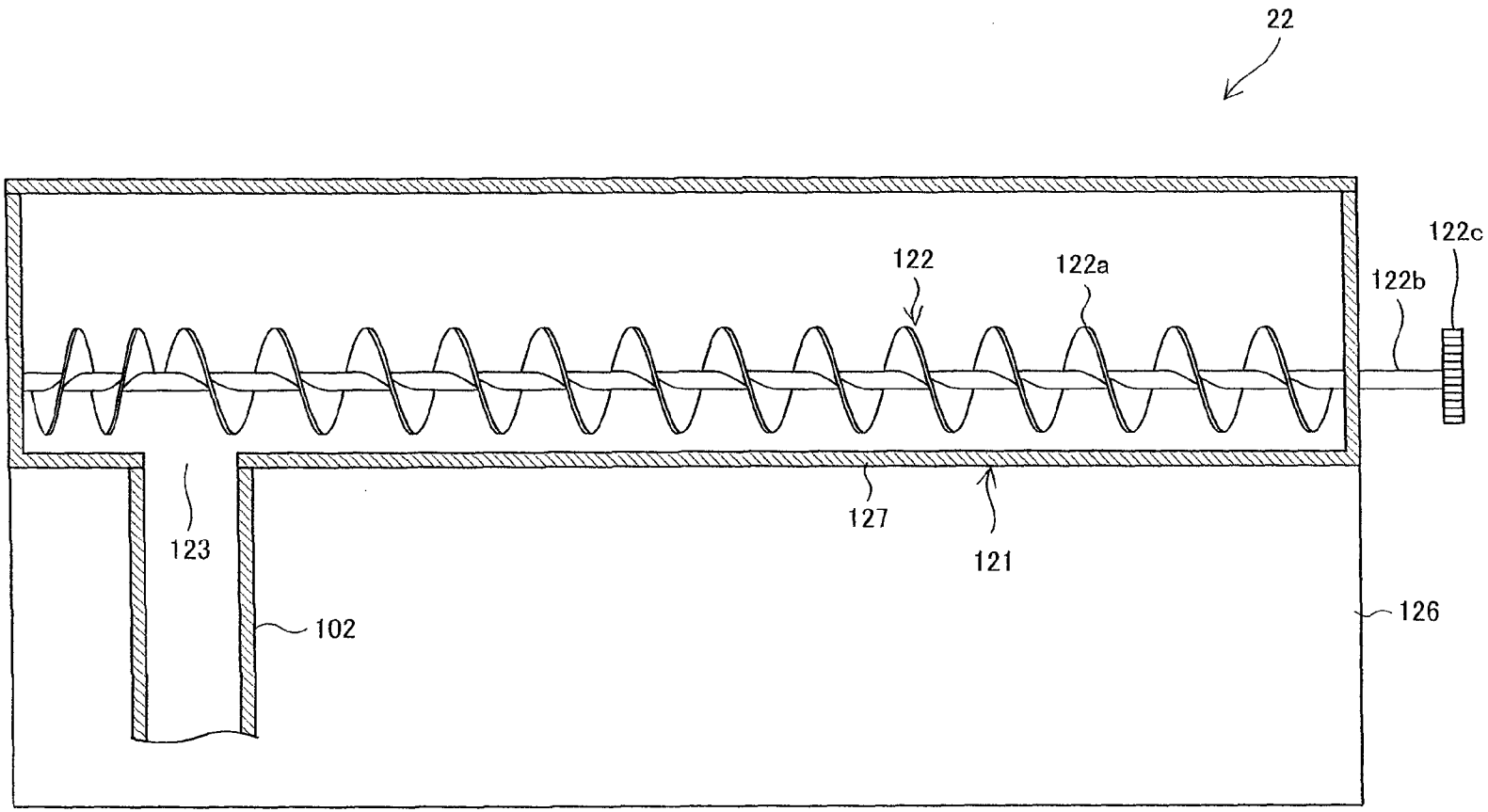
FIG. 3 is a cross sectional view taken along C-C line shown in FIG. 2

FIG. 2 is a longitudinal cross-sectional view showing an arrangement of a toner supply device shown in FIG. 1. FIG. 3 is a cross sectional view taken along C-C line shown in FIG. 2.

As shown in FIG. 2, the toner supply device 22 is provided with a toner container 121, a toner-stirring member 125 and a toner discharge member 122.

The toner container 121 includes a toner reservoir 126 and a toner discharge section 127. The toner reservoir 126 is a semicylindrical container having a space in its container. The toner discharge section 127 is a container smaller than the toner reservoir 126 which container has a space in its container. The toner discharge section 127 is provided adjacent to the toner reservoir 126 so as to be along the toner reservoir 126. The toner reservoir 126 and the toner discharge section 127 extend in an axial direction of the photoreceptor drum 3.

As shown in FIG. 3, a toner discharge opening 123 is provided in a bottom wall in the vicinity of one edge of a longitudinal direction of the toner discharge section 127. The toner discharge opening 123 is in a shape of, for example, a rectangle. The toner discharge opening 123 is connected to an upper part of a toner carrying pipe 102. A lower part of the toner carrying pipe 102 is connected to a developing tank 111 of the developing device 2 (see FIG. 4).

The toner reservoir 126 is provided with the toner stirring-member 125. Further, the toner discharge section 127 is provided with the toner discharge member 122. These toner-stirring member 125 and toner discharge member 122 are rotated by driving means (not shown).

As shown in FIG. 2, the toner-stirring member 125 includes a plate 125*c* extending in a longitudinal direction of the toner reservoir 126. A toner draw member 125*b* is provided in both sides of the plate 125*c*. The toner draw member 125*b* is made of, for example, polyethylene terephthalate (PET) having flexibility. The toner-stirring member 125 rotates about a rotary shaft 125*a* so as to draw the toner stored in the toner reservoir 126 while stirring the toner, thereby supplying the toner to the toner discharge section 127.

Further, a blocking wall 124 is provided between the toner reservoir 126 and the toner discharge section 127. The blocking wall 124 allows moderate amounts of toner drawn up from the toner reservoir 126 by the toner stirring-member 125 to be supplied to the toner discharge section 127.

The toner discharge member 122 rotates so as to discharge, from the toner discharge opening 123, the toner supplied from the toner reservoir 126 to the toner discharge section 127 and supply the toner to the developing tank 111. As shown in FIG. 3, the toner discharge member 122 includes: an auger screw including a toner carrying blade 122*a* and a rotary shaft 122*b*; and a rotation gear 122*c* attached to the rotary shaft 122*b*. Rotary driving force of driving means (not shown) is transmitted to the rotation gear 122*c*. The toner discharge member 122 is rotated by this rotary driving force. The auger screw carries a toner in such directions that are from one end of the longitudinal direction of the toner discharge section 127 to the toner discharge opening 123 and from the other end of the longitudinal direction of the toner discharge section 127 to toner discharge opening 123. That is, rotation of the auger screw makes it possible to carry, toward the toner discharge opening 123, toner present in both sides of the toner discharge opening 123 of the toner discharge section 127 and discharge the toner from the toner discharge opening 123.

(Developing Device)

Figure 4:
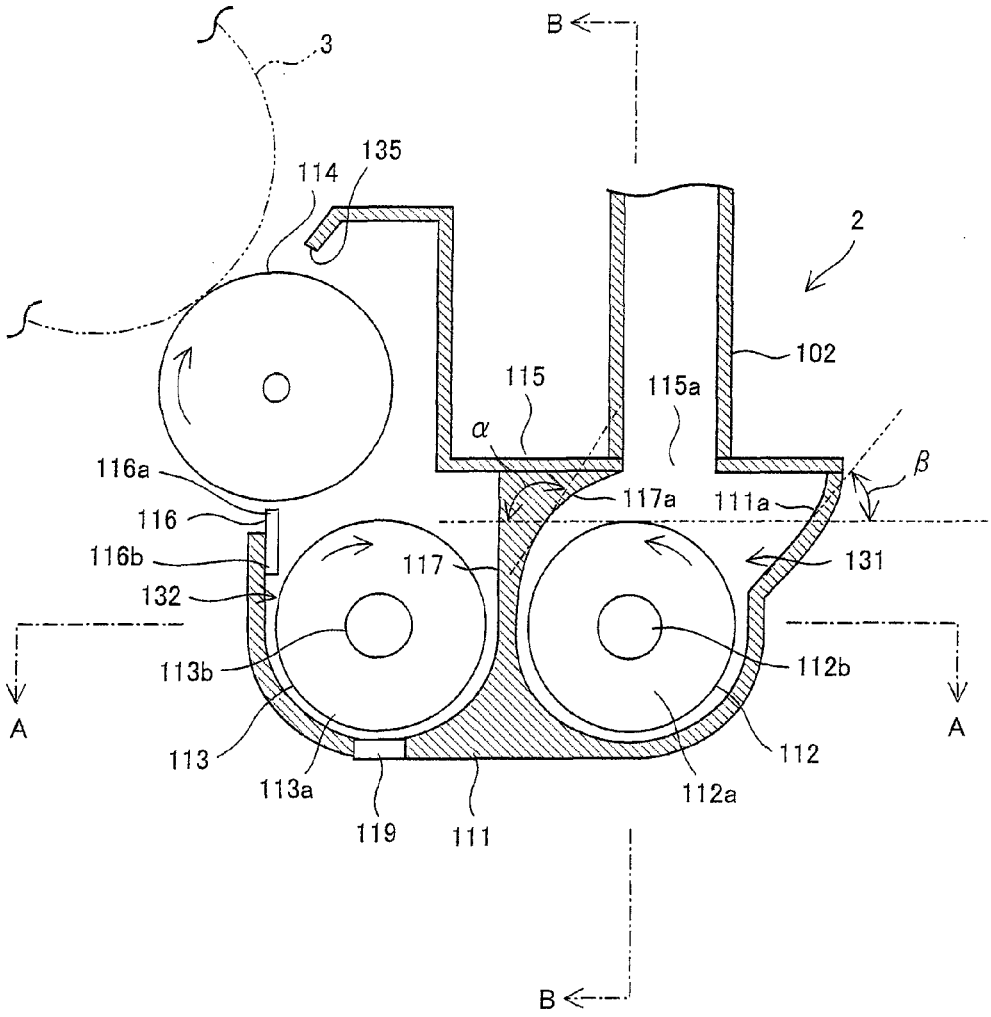
FIG. 4 is a longitudinal cross-sectional view of a developing device shown in FIG. 1.
Figure 5:
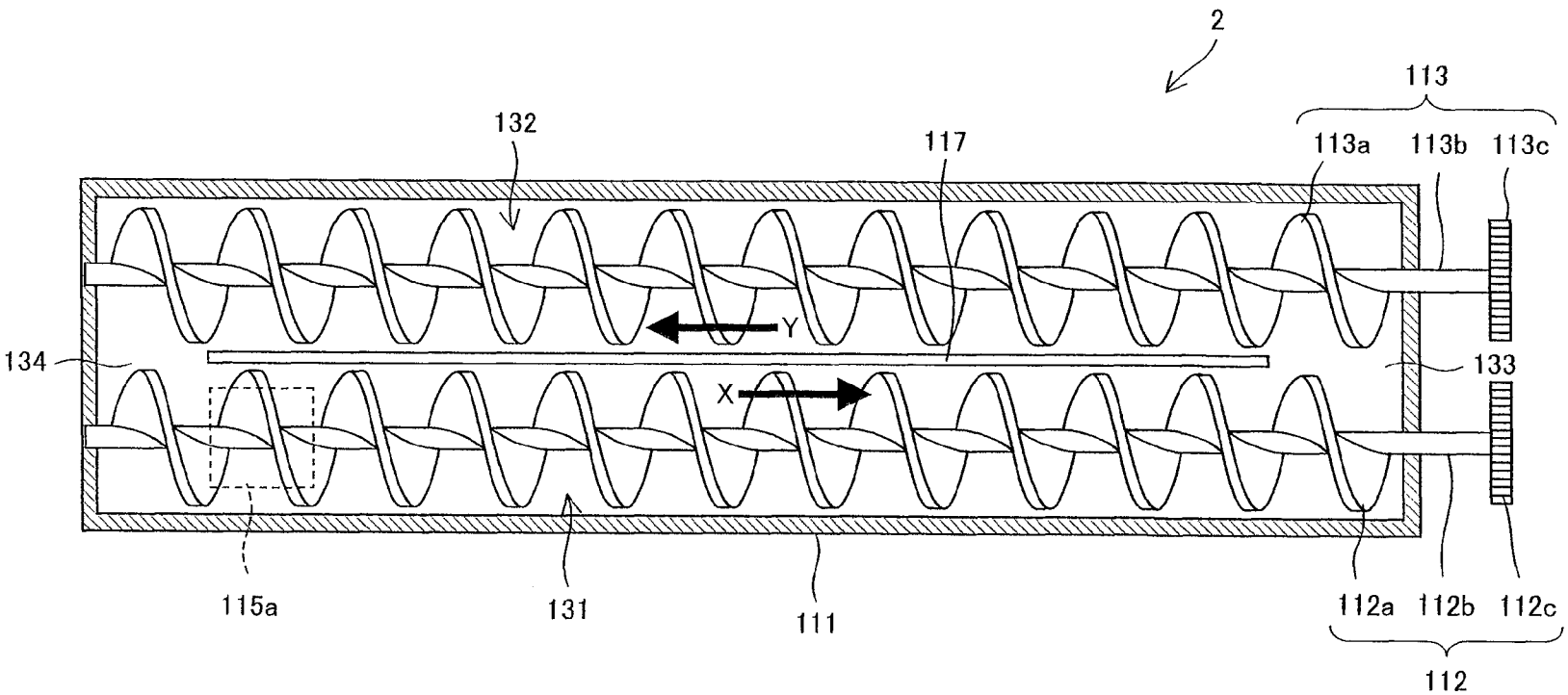
FIG. 5 is a cross sectional view taken along A-A line shown in FIG. 4.
Figure 6:
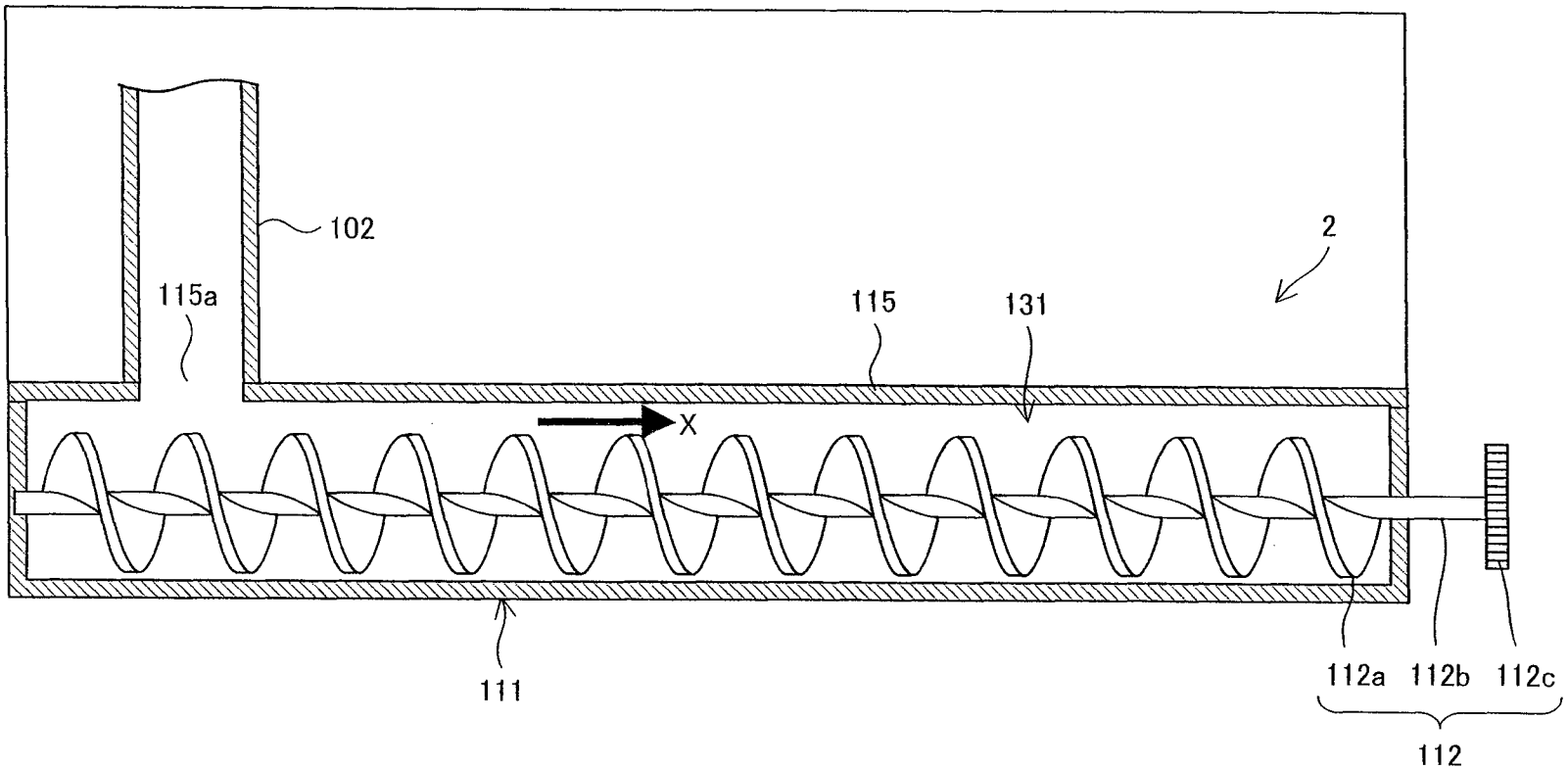
FIG. 6 is a cross sectional view taken along B-B line shown in FIG. 4.

FIG. 4 is a longitudinal cross-sectional view of the developing device 2 shown in FIG. 1. FIG. 5 is a cross sectional view taken along A-A line shown in FIG. 4. FIG. 6 is a cross sectional view taken along B-B line shown in FIG. 4.

As shown in FIG. 4, the developing device 2 is provided with the developing tank 111, a first stirring carrying member (auger screw, stirring carrying member) 112, a second stirring carrying member (auger screw) 113, a developing roller 114, a doctor blade 116, and a toner density detection sensor 119 made up of a permeability sensor.

The developing tank 111 stores a two component developer containing a toner and a magnetic carrier. The developing tank 111 is divided into a first developer carrying path 131 and a second developer carrying path 132 by a partition board (first sidewall) 117. These first developer carrying path 131 and second developer carrying path 132 extend in an axial direction of the photoreceptor 3, and are arranged in parallel with each other. The first developer carrying path 131 is provided more distant from the photoreceptor 3 than the second developer carrying path 132, and the second developer carrying path 132 is provided closer to the photoreceptor 3 than the first developer carrying path 131.

The first developer carrying path 131 and the second developer carrying path 132 are covered with a developing tank cover 115. The developing tank cover 115 of the present embodiment is detachable. A toner supply opening 115*a* is provided in a place of the developing tank cover 115 which place is above the first developer carrying path 131. The lower part of the toner carrying pipe 102 is connected to the toner supply opening 115*a*. Therefore, the toner discharged from the toner discharge opening 123 of the toner supply device 22 is carried through the toner carrying pipe 102, and supplied from the toner supply opening 115*a* into the first developer carrying path 131.

The first stirring carrying member 112 is provided in the first developer carrying path 131, and the second stirring carrying member 113 is provided in the second developer carrying path 132. Specifically, the first stirring carrying member 112 and the second stirring carrying member 113 are provided such that an outer circumference of the first stirring carrying member 112 faces an outer circumference of the second stirring carrying member 113 via the partition board 117 and the first stirring carrying member 112 and the second stirring carrying member 113 are axially parallel with each other.

As shown in FIGS. 5 and 6, the first stirring carrying member 112 includes: a spiral auger screw containing a first carrying blade 112*a* and a first rotary shaft 112*b*; and a first carrying gear 112*c*. The first carrying gear 112*c* is attached to an edge part of the first rotary shaft 112*b* which edge part projects from the developing tank 111.

Similarly, as shown in FIG. 5, the second stirring carrying member 113 includes: a spiral auger screw containing a second carrying blade 113*a* and a second rotary shaft 113*b*; and a second carrying gear 113*c*. The second carrying gear 113*c* is attached to an edge part of the second rotary shaft 113*b* which edge part projects from the developing tank 111.

The first stirring carrying member 112 and the second stirring carrying member 113 are rotated reversely to each other by driving means (not shown), thereby carrying the developer while stirring the developer. As shown in FIG. 4, the first stirring carrying member 112 of the present embodiment rotates leftward, and the second stirring carrying member 113 and the developing roller 114 of the present embodiment rotate rightward.

As shown in FIG. 5, a developer included in the first developer carrying path 131 is carried in a direction of arrow X by rotation of the first stirring carrying member 112, and a developer included in the second developer carrying path 132 is carried in a direction of arrow Y by rotation of the second stirring carrying member 113.

Both edges of the partition board 117 which edges are positioned in axial directions of the first stirring carrying member 112 and the second stirring carrying member 113 are separate from internal wall surfaces of the developing tank 111. This forms a first communicating path 133 between the edge of the direction of arrow X of the partition board 117 and the wall of the developing tank 111. The first communicating path 133 communicates the first developer carrying path 131 with the second developer carrying path 132. This also forms a second communicating path 134 between the edge of the direction of arrow Y of the partition board 117 and the wall of the developing tank 111. The second communicating path 134 communicates the first developer carrying path 131 with the second developer carrying path 132.

Accordingly, the developer included in the first developer carrying path 131 is carried in the direction of arrow X by the first stirring carrying member 112, and then carried into the second developer carrying path 132 via the first communicating path 133. Further, the developer included in the second developer carrying path 132 is carried in the direction of arrow Y by the second stirring carrying member 113, and then carried into the first developer carrying path 131 via the second communicating path 134. That is, the developer included in the developing tank 111 circulates through the first developer carrying path 131 and the second developer carrying path 132. Specifically, the developer included in the developing tank 111 circulates through the first developer carrying path 131, the first communicating path 133, the second developer carrying path 132, the second communicating path 134, and the first developer carrying path 131, in this order.

The developer is held on a surface of the developing roller 114 and drawn up by rotation of the developing roller 114 while being carried in the second developer carrying path 132. A toner included in the drawn developer is carried to the photoreceptor drum 3, and sequentially consumed. Further, in order to compensate quantity of the consumed toner, a toner to be consumed is supplied from the toner supply device 22 to the first developer carrying path 131. The supplied toner is mixed and stirred with a developer already present in the first developer carrying path 131.

FIG. 5 shows, by a dash line, a place where the toner supply opening 115*a* is formed. Specifically, the toner supply opening 115*a* is formed above the first developer carrying path 131 and in a region of the first developer carrying path 131 which region is closer to a downstream side of the toner carrying direction (direction of arrow X) than the second communicating path 134, and in a region of the first developer carrying path 131 which region is closer to a upstream side of the toner carrying direction than a center part of the toner carrying direction of the first developer carrying path 131. More specifically, the toner supply opening 115*a* is formed above the first developer carrying path 131 and in a region of the first developer carrying path 131 which region aligns with the edge of the direction of arrow Y of the partition board 117, and in a region of the first developer carrying path 131 which region is along a side surface of the partition board 117. Accordingly, the toner supplied from the toner supply opening 115*a* falls into the above-described place (place shown by the dash line) of the first developer carrying path 131.

The developing roller 114 is rotated by driving means (not shown) so as to draw up and hold, on the surface of the developing roller 114, the developer included in the second developer carrying path 132 and supply the toner included in the held developer to the electrostatic latent image formed on the surface of the photoreceptor drum 3. Therefore, the developing roller 114 is provided above the second stirring carrying member 113 so as to face the photoreceptor drum 3 via a specific interval between the developing roller 114 and the photoreceptor drum 3. A bias voltage is applied to the developing roller 114 so that the developing roller 114 supplies the toner to the photoreceptor drum 3.

Further, an opening 135 is formed in a place of the developing tank 111 in which place the developing roller 114 is provided so as to face the photoreceptor drum 3. The doctor blade 116 is provided in a part of the developing tank 111 which part is positioned along the opening 135 of the developing tank 111 and adjacent to the surface of the developing roller 114. The doctor blade 116 is an oblong plate-like member extending in parallel to an axial direction of the developing roller 114. A lower edge 116*b* of the doctor blade 116 is fixed to the developing tank 111, and an upper edge 116*a* of the doctor blade 116 is provided so as to be distant from the surface of the developing roller 114 via a specific interval.

The toner density detection sensor 119 is attached to a bottom wall of a substantially central part of the developer carrying direction of the second developer carrying path 132. Further, the toner density detection sensor 119 is connected to toner density control means (not shown). The toner density control means controls the toner discharge member 122 to rotate according to a measurement value of toner density detected by the toner density detection sensor 119, such that the toner discharge member 122 supplies a toner to the developing tank 111 via the toner discharge opening 123.

(First Developer Carrying Path)

As described above, the first developer carrying path 131 of the developing tank 111 is provided with the first stirring carrying member 112, and a toner is supplied from the toner supply device 22 to the first developer carrying path 131. The toner supplied from the toner supply device 22 is carried to the first developer carrying path 131 via the toner supply opening 115*a*.

A lower space region of the first developer carrying path 131, that is, a space region of the first developing carrying path 131 which space region is lower than the height of the first rotary shaft 112*b* of the first stirring carrying member 112 is a region (semicircular region) concentric with the first carrying blade 112*a* which region has a diameter slightly larger than that of the first carrying blade 112*a* of the first stirring carrying member 112. Similarly, a lower space region of the second developer carrying path 132, that is, a space region of the second developing carrying path 132 which space region is lower than the height of the second rotary shaft 113*b* of the second stirring carrying member 113 is a region (semicircular region) concentric with the second carrying blade 113*a* which region has a diameter slightly larger than that of the second carrying blade 113*a* of the second stirring carrying member 113.

As shown in FIG. 4, the first developer carrying path 131 has left and right handed sidewalls. Among the left and right handed sidewalls, a sidewall that faces downward rotation of the first stirring carrying member 112, that is, a sidewall on which a developer sinks is formed with the partition board 117, and a sidewall that faces upward rotation of the first stirring carrying member 112, that is, a sidewall on which the developer is drawn up is formed with the sidewall of the developing tank 111.

Further, when seen in a width direction of the first developer carrying path 131, the center of the toner supply opening 115*a* is positioned closer to the sidewall on which the developer is drawn up than the first rotary shaft 112*b* of the first stirring carrying member 112 is.

Further, an opening dimension of the width direction of the first developer carrying path 131 of the toner supply opening 115*a* is narrower than a width of the first developer carrying path 131 at a height of the first rotary shaft 112*b* of the first stirring carrying member 112.

An upper part of an inner wall surface of the sidewall that faces downward rotation of the first stirring carrying member 112 (sidewall on which the developer sinks) which upper part is above the vicinity of the height of the first rotary shaft 112*b* of the first stirring carrying member 112, that is, an upper inner wall surface 117*a* of a side in which a developer sinks (inner wall surface of first sidewall) is curved. As shown in FIG. 4, an angle made by a direction perpendicular to a horizontal surface and the upper inner wall surface 117*a* increases gradually from the vicinity of a position of the upper inner wall surface 117*a* which position is at the height of the first rotary shaft 112*b* to a position of the upper inner wall surface 117*a* which position reaches the toner supply opening 115*a*. Further, the upper inner wall surface 117*a* is arranged such that a distance between the upper inner wall surface 117*a* and an outer circumference of the first carrying blade 112*a* increases gradually from the vicinity of the position of the upper inner wall surface 117*a* which position is at the height of the first rotary shaft 112*b* to the position of the upper inner wall surface 117*a* which position reaches the toner supply opening 115*a*.

That is, the upper inner wall surface 117*a* inclines toward the first developer carrying path 131 from the direction perpendicular to the horizontal surface. Specifically, the upper inner wall surface 117*a* is arranged such that, in a cross section perpendicular to the first rotary shaft 112*b* of the first stirring carrying member 112, an angle $\alpha$ made by (i) a tangential line of the upper inner wall surface 117*a* at a position of the upper inner wall surface 117*a* which position is at a height of a top part of the first carrying blade 112*a* (highest position of a peripheral part of the first carrying blade 112*a*) and (ii) a horizontal line is not less than 100° but not more than 150°. The angle $\alpha$ is preferably not less than 120° but not more than 140°.

Meanwhile, an upper part of an inner wall surface of the sidewall that faces upward rotation of the first stirring carrying member 112 (sidewall on which a developer is drawn up) which upper part is above the vicinity of the height of the first rotary shaft 112*b* of the first stirring carrying member 112, that is, an upper inner wall surface 111*a* of a side in which a developer is drawn up (inner wall surface of second sidewall) is curved. As shown in FIG. 4, an angle made by the direction perpendicular to the horizontal surface and the upper inner wall surface 111*a* is greatest in the vicinity of a position of the upper inner wall surface 111*a* which position is at the height of the first rotary shaft 112*b*, and the angle is decreased gradually toward a position of the upper inner wall surface 111*a* which position reaches the developing tank cover 115 (height of the toner supply opening 115*a*). Further, the upper inner wall surface 111*a* is arranged such that a distance between the upper inner wall surface 111*a* and the outer circumstance of the first carrying blade 112*a* increases gradually from the vicinity of the position of the upper inner wall surface 111*a* which position is at the height of the first rotary shaft 112*b* to the position of the upper inner wall surface 111*a* which position reaches the developing tank cover 115.

That is, the upper inner wall surface 111*a* inclines with respect to the direction perpendicular to the horizontal surface to be away from the first developer carrying path 131. Specifically, the upper inner wall surface 111*a* is arranged such that, in the cross section perpendicular to the first rotary shaft 112*b* of the first stirring carrying member 112, an angle $\beta$ made by (i) a tangential line of the upper inner wall surface 111*a* at the position of the upper inner wall surface 111*a* which position is at the height of the top part of the first carrying blade 112*a* (highest position of the peripheral part of the first carrying blade 112*a*) and (ii) a horizontal line is not less than 30° but not more than 60°. The angle $\beta$ is preferably not less than 40° but not more than 50°.

The toner supply opening 115*a* is formed in a part of the developing tank cover 115 of the developing tank 111. FIG. 4 shows a longitudinal cross-sectional view of the developing device 2, particularly, a part where the toner supply opening 115*a* is formed. FIG. 4 does not show a part of the upper inner wall surface 117*a* that inclines from the direction perpendicular to the horizontal surface which part extends in a longitudinal direction of the partition board 117. However, such an above-described arrangement of the upper inner wall surface

117*a* is preferably provided not only in a region where the toner supply opening 115*a* is formed but also in a whole part of the upper inner wall surface 117*a* which whole part extends in the longitudinal direction of the partition board 117. Further, such an above-described arrangement of the upper inner wall surface 111*a* that inclines from the direction perpendicular to the horizontal surface is preferably provided not only in the region where the toner supply opening 115*a* is formed but also in a whole part of the upper inner wall surface 111*a* which whole part extends in the longitudinal direction of the partition board 117.

According to the above arrangement, a toner supplied from the toner discharge opening 123 of the toner supply device 22 via the toner carrying pipe 102 is supplied from the toner supply opening 115*a* of the developing tank 111 into the first developer carrying path 131.

Thereafter, the toner supplied into the first developer carrying path 131 is stirred with an existing developer by rotation of the first stirring carrying member 112. As shown in FIG. 5, the developer including the supplied toner in the first developer carrying path 131 is carried, by rotation of the first stirring carrying member 112 and the second stirring carrying member 113, circularly around the first developer carrying path 131, the first communicating path 133, the second developer carrying path 132, the second communicating path 134 and the first developer carrying path 131, in this order. The developer carried to the second developer carrying path 132 is held on the surface of the developing roller 114, and the toner included in the developer is supplied to the electrostatic latent image formed on the surface of the photoreceptor drum 3. In this manner, the electrostatic latent image is developed.

The toner supplied from the toner supply opening 115*a* to the first developer carrying path 131 has an apparent density smaller (lighter) than that of the developer (carrier). Therefore, the toner is easy to float in an upper part of the developer. Meanwhile, the upper inner wall surface 117*a* inclines from the direction perpendicular to the horizontal surface toward the first developer carrying path 131. Specifically, the upper inner wall surface 117*a* is arranged such that, in the cross section perpendicular to the first rotary shaft 112*b* of the first stirring carrying member 112, the angle $\alpha$ made by (i) the tangential line of the upper inner wall surface 117*a* at the position of the upper inner wall surface 117*a* which position is at the height of the top part of the first carrying blade 112*a* and (ii) the horizontal line is not less than 100° but not more than 150°. This arrangement makes it possible to properly stir the toner with the existing developer without applying excessive stress on the developer, by rotation of the first stirring carrying member 112. That is, even in a case where the toner floats in the upper part of the developer, the toner supplied into the first developer carrying path 131 is easily captured, by rotation of the first stirring carrying member 112, between the upper inner wall surface 117*a* and the first stirring carrying member 112. The toner captured between the upper inner wall surface 117*a* and the first stirring carrying member 112 is subject to shearing force due to rotation of the first stirring carrying member 112. This makes it easy to stir the toner with the developer so as to disperse the toner in the developer.

In a case where the angle $\alpha$ is not less than 120° but not more than 140°, it is possible to further suitably stir the supplied toner with the developer in the first developer carrying path 131.

Further, an upper edge of the upper inner wall surface 117*a* reaches the toner supply opening 115*a*, and the angle made by the direction perpendicular to the horizontal surface and the upper inner wall surface 117*a* increases gradually from the vicinity of the position of the upper inner wall surface 117*a* which position is at the height of the first rotary shaft 112*b* to the position of the upper inner wall surface 117*a* which position reaches the toner supply opening 115*a*. Further, the upper inner wall surface 117*a* is arranged such that the distance between the upper inner wall surface 117*a* and the outer circumference of the first carrying blade 112*a* increases gradually from the vicinity of the position of the upper inner wall surface 117*a* which position is at the height of the first rotary shaft 112*b* to the position of the upper inner wall surface 117*a* which position reaches the toner supply opening 115*a*. Such an arrangement makes it possible to further easily capture, between the partition board 117 (inner wall surface of the side in which a developer sinks of the first developer carrying path 131) and the first stirring carrying member 112, the toner supplied to the first developer carrying path 131, and further promote stirring the supplied toner with the existing developer.

Further, when seen in the width direction of the first developer carrying path 131, the center of the toner supply opening 115*a* is positioned closer to the sidewall on which the developer is drawn up than the first rotary shaft 112*b* of the first stirring carrying member 112 is. This arrangement makes it easy to form a region between the partition board 117 and the first stirring carrying member 112 into which region the toner supplied into the first developer carrying path 131 is supplied.

According to the present embodiment, a part of the inner wall surface of the partition board 117 which inner wall surface faces the first developer carrying path 131 which part is above the vicinity of the height of the first rotary shaft 112*b* of the first stirring carrying member 112 is the upper inner wall surface 117*a*. The upper inner wall surface 117*a* is arranged such that the angle made by the direction perpendicular to the horizontal surface and the upper inner wall surface 117*a* increases gradually from the vicinity of the position of the upper inner wall surface 117*a* which position is at the height of the first rotary shaft 112*b* to the position of the upper inner wall surface 117*a* which position reaches the toner supply opening 115*a*. Meanwhile, the upper inner wall surface 117*a* may be arranged such that a part of the upper inner wall surface 117*a* which part ranges from the position of the upper inner wall surface 117*a* which position is at the height of the top part of the first carrying blade 112*a* of the first stirring carrying member 112 to the position of the upper inner wall surface 117*a* which position reaches the toner supply opening 115*a* formed in the developing tank cover 115 inclines from the direction perpendicular to the horizontal surface toward the first developer carrying path 131. This arrangement also makes it possible to promote stirring, with the existing developer, the toner supplied into the first developer carrying path 131.

Further, the upper inner wall surface 111*a* inclines with respect to the direction perpendicular to the horizontal surface to be away from the first developer carrying path 131. Specifically, the upper inner wall surface 111*a* is arranged such that, in the cross section perpendicular to the first rotary shaft 112*b* of the first stirring carrying member 112, the angle $\beta$ made by (i) the tangential line of the upper inner wall surface 111*a* at the position of the upper inner wall surface 111*a* which position is at the height of the top part of the first carrying blade 112*a* and (ii) the horizontal line is not less than 30° but not more than 60°. This arrangement suppresses the developer whose density is decreased by being stirred with the supplied toner to excessively rise in a region where the first stirring carrying member 112 rotates upward. This makes it possible to suppress deterioration in a developer stirring function of the first stirring carrying member 112.

Further, the volume of the region in which the first stirring carrying member 112 rotates downward and the toner supplied from the toner supply opening 115*a* to the first developer carrying path 131 disperses is decreased by inclining the upper inner wall surface 117*a* from the direction perpendicular to the horizontal surface toward the first developer carrying path 131. However, the decreased volume is compensated with the volume of the region where the first stirring carrying member 112 rotates upward which volume is obtained by inclining the upper inner wall surface 111*a* with respect to the direction perpendicular to the horizontal surface to be away from the first developer carrying path 131. This also makes it possible to suppress deterioration in the developer stirring function.

In the case where the angle β is not less than 40° but not more than 50°, it is possible to further suppress deterioration in the developer stirring function of the first stirring carrying member 112.

The developing device may be arranged such that the angle α is not less than 120° but not more than 140°.

The above arrangement makes it possible to further suitably stir the supplied toner with the developer in the developer carrying path.

The developing device may be arranged such that the upper part of the inner wall surface of the first sidewall reaches the toner supply opening, an angle made by the direction perpendicular to the horizontal surface and the inner wall surface of the first sidewall increases gradually from a position of the inner wall surface of the first sidewall which position is at a height of the rotary shaft of the stirring carrying member to a position of the inner wall surface of the first sidewall which position reaches the toner supply opening, and a distance between the inner wall surface of the first sidewall and the outer circumference of the stirring carrying member increases gradually from the position of the inner wall surface of the first sidewall which position is at the height of the rotary shaft of the stirring carrying member to the position of the inner wall surface of the first sidewall which position reaches the toner supply opening.

The above arrangement makes it possible to further easily capture, between the inner wall surface of the first sidewall and the stirring carrying member, the toner supplied into the developer carrying path, and further promote stirring the supplied toner with the existing developer.

The developer device may be arranged such that when seen in the width direction of the developer carrying path, a center of the toner supply opening is positioned closer to the second sidewall that faces upward rotation of the stirring carrying member than the rotary shaft of the stirring carrying member is.

According to the above arrangement, when seen in the width direction of the developer carrying path, the center of the toner supply opening is positioned closer to the second sidewall that faces upward rotation of the stirring carrying member than the rotary shaft of the stirring carrying member is. This makes it easy to form a region between the first sidewall and the stirring carrying path into which region the toner supplied into the developer carrying path is taken.

The developing device may be arranged such that the second sidewall having an inner wall surface that has an upper part that faces upward rotation of the stirring carrying member inclines with respect to the direction perpendicular to the horizontal surface to be away from the developer carrying path, an angle β made by (i) a tangential line of the inner wall surface of the second sidewall at a position of the inner wall surface of the second sidewall which position is at the height of the top part of the outer circumference of the stirring carrying member and (ii) the horizontal line is not less than 30° but not more than 60°.

According to the above arrangement, the upper part of the inner wall surface of the second sidewall that faces upward rotation of the stirring carrying member inclines with respect to the direction perpendicular to the horizontal surface to be away from the developer carrying path, and the angle β made by (i) the tangential line of the inner wall surface of the second sidewall at the position of the inner wall surface of the second sidewall which position is at the height of the top part of the outer circumference of the stirring carrying member and (ii) the horizontal line is not less than 30° but not more than 60°. This arrangement suppresses the developer whose density is decreased by being stirred with the supplied toner to excessively rise in a region where the stirring carrying member rotates upward (surface of the developer to rise). This makes it possible to suppress deterioration in a developer stirring function of the stirring carrying member.

Further, the volume of a region where the stirring carrying member rotates downward and the toner supplied from the toner supply opening to the developer carrying path disperses is decreased by inclining the inner wall surface of the first sidewall from the direction perpendicular to the horizontal surface toward the developer carrying path. However, the decreased volume is compensated with the volume of the region where the stirring carrying member rotates upward which volume is obtained by inclining the inner wall surface of the second sidewall with respect to the direction perpendicular to the horizontal surface to be away from the developer carrying path. This also makes it possible to suppress deterioration in the developer stirring function.

The developing device may be arranged such that the angle β is not less than 40° but not more than 50°.

The above arrangement makes it possible to further suppress deterioration in the developer stirring function of the stirring carrying member.

The present invention is not limited to the description of the embodiments above, but may be altered by a skilled person within the scope of the claims. An embodiment based on a proper combination of technical means disclosed in different embodiments is encompassed in the technical scope of the present invention.

REFERENCE SIGNS LIST

2: developing device
3: photoreceptor
8: intermediate transfer belt unit (transfer device)
12: fixing device
22: toner supply device
100: image forming apparatus
102: toner carrying pipe
111: developing tank
111*a*: upper inner wall surface of a side in which a developer is drawn up (inner wall surface of second sidewall)
112: first stirring carrying member (stirring carrying member)
112*a*: first carrying blade
112*b*: first rotary shaft
113: second stirring carrying member
113*a*: second carrying blade
113*b*: second rotary shaft
114: developing roller
115: developing tank cover
115*a*: toner supply opening
117: partition board (first sidewall)

117*a*: upper inner wall surface of a side in which a developer sinks (inner wall surface of first sidewall)
122: toner discharge member.
123: toner discharge opening
126: toner storage section
127: toner discharge section
131: first developer carrying path
132: second developer carrying path
133: first communicating path
134: second communicating path

The invention claimed is:

1. A developing device, comprising:

a developing tank for storing a developer containing a toner and a magnetic carrier, the developing tank including, inside thereof, a developer carrying path that extends in one direction; and a stirring carrying member which is provided in the developer carrying path and which rotates so that the stirring carrying member carries the developer included in the developer carrying path while stirring the developer, the developing device developing by use of the developer carried from the developer carrying path by the stirring carrying member, the developing tank having an upper wall above the developer carrying path, the upper wall having a toner supply opening through which a toner is supplied to the developer carrying path from an outside, the developer carrying path being defined by first and second sidewalls present respectively in both sides of the width direction of the developer carrying path, the first sidewall facing downward rotation of the stirring carrying member, the first sidewall having an inner wall surface that has an upper part inclining from a direction perpendicular to a horizontal surface toward the developer carrying path, and an angle $\alpha$, made by (i) a tangential line of the inner wall surface of the first sidewall at a position of the inner wall surface of the first sidewall which position is at a height of a top part of an outer circumference of the stirring carrying member and (ii) a horizontal line, being not less than 100° but not more than 150°, wherein:

the upper part of the inner wall surface of the first sidewall reaches the toner supply opening, an angle made by the direction perpendicular to the horizontal surface and the inner wall surface of the first sidewall increases gradually from a position of the inner wall surface of the first sidewall which position is at a height of the rotary shaft of the stirring carrying member to a position of the inner wall surface of the first sidewall which position reaches the toner supply opening, and a distance between the inner wall surface of the first sidewall and the outer circumference of the stirring carrying member increases gradually from the position of the inner wall surface of the first sidewall which position is at the height of the rotary shaft of the stirring carrying member to the position of the inner wall surface of the first sidewall which position reaches the toner supply opening.

2. The developing device as set forth in claim 1, wherein:

when seen in the width direction of the developer carrying path, a center of the toner supply opening is positioned closer to the second sidewall that faces upward rotation of the stirring carrying member than the rotary shaft of the stirring carrying member is.

3. The developing device as set forth in claim 1, wherein:

the second sidewall having an inner wall surface that has an upper part that faces upward rotation of the stirring carrying member inclines with respect to the direction perpendicular to the horizontal surface to be away from the developer carrying path, an angle $\beta$ made by (i) a tangential line of the inner wall surface of the second sidewall at a position of the inner wall surface of the second sidewall which position is at the height of the top part of the outer circumference of the stirring carrying member and (ii) the horizontal line is not less than 30° but not more than 60°.

4. An image forming apparatus, comprising:

a developing device;

a photoreceptor on which surface an electrostatic latent image is formed, the electrostatic latent image being developed by the developing device;

a transfer device for transferring, to a paper, a toner image formed on the surface of the photoreceptor by developing the electrostatic latent image; and a fixing device for fixing the toner image to the paper to which the toner image is transferred, the developing device, comprising:

a developing tank for storing a developer containing a toner and a magnetic carrier, the developing tank including, inside thereof, a developer carrying path that extends in one direction; and a stirring carrying member which is provided in the developer carrying path and which rotates so that the stirring carrying member carries the developer included in the developer carrying path while stirring the developer, the developing device developing by use of the developer carried from the developer carrying path by the stirring carrying member, the developing tank having an upper wall above the developer carrying path, the upper wall having a toner supply opening through which a toner is supplied to the developer carrying path from an outside, the developer carrying path being defined by first and second sidewalls present respectively in both sides of the width direction of the developer carrying path, the first sidewall facing downward rotation of the stirring carrying member, the first sidewall having an inner wall surface that has an upper part inclining from a direction perpendicular to a horizontal surface toward the developer carrying path, and an angle $\alpha$, made by (i) a tangential line of the inner wall surface of the first sidewall at a position of the inner wall surface of the first sidewall which position is at a height of a top part of an outer circumference of the stirring carrying member and (ii) a horizontal line, being not less than 100° but not more than 150°, wherein:

the upper part of the inner wall surface of the first sidewall reaches the toner supply opening, an angle made by the direction perpendicular to the horizontal surface and the inner wall surface of the first sidewall increases gradually from a position of the inner wall surface of the first sidewall which position is at a height of the rotary shaft of the stirring carrying member to a position of the inner wall surface of the first sidewall which position reaches the toner supply opening, and a distance between the inner wall surface of the first sidewall and the outer circumference of the stirring carrying member increases gradually from the position of the inner wall surface of the first sidewall which position is at the height of the rotary shaft of the stirring carrying member to the position of the inner wall surface of the first sidewall which position reaches the toner supply opening.

* * * * *